United States Patent [19]

Yonkers

[11] Patent Number: 4,912,958

[45] Date of Patent: Apr. 3, 1990

[54] HAND TOOL FOR PRESSING WIRE CONNECTORS

[75] Inventor: Edward H. Yonkers, Evanston, Ill.

[73] Assignee: Electro-Appliance Co., Inc., Chicago, Ill.

[21] Appl. No.: 340,374

[22] Filed: Apr. 19, 1989

[51] Int. Cl.[4] ..... B21D 7/06

[52] U.S. Cl. ..... 72/410; 29/751; 81/367; 81/382; 7/127

[58] Field of Search ..... 72/410, 409, 461, 416; 29/751; 81/367–380, 313, 418, 382; 7/127

[56] References Cited

U.S. PATENT DOCUMENTS

| | | | |
|---|---|---|---|
| 2,574,676 | 11/1951 | Waterbury | 81/380 |
| 2,589,511 | 3/1952 | Redmon | 81/370 |
| 2,592,803 | 4/1952 | Heim | 81/380 |
| 3,553,999 | 1/1971 | Rommel | 72/410 |
| 3,630,068 | 12/1971 | Floyd, Jr. | 72/410 |

FOREIGN PATENT DOCUMENTS

| | | | |
|---|---|---|---|
| 1522144 | 8/1978 | United Kingdom | 72/410 |

*Primary Examiner*—Daniel C. Crane
*Attorney, Agent, or Firm*—Mason, Kolehmainen, Rathburn & Wyss

[57] ABSTRACT

A hand tool for pressing wire connectors to establish electrical connection between a plurality of insulated wires inserted into the connector includes an elongatged body having a mouth at one end for receiving a wire connector with wires inserted therein. A movable jaw is pivotally mounted on the body for movement about a first pivot laterally offset from a longitudinal axis of the body forming a movable wall of the mouth for compressing the connector to a precise geometric configuration. An operating handle is pivotally connected to the jaw for movement about a second pivot on the jaw and the handle has an opposite outer end portion movable toward and away from the tool body for moving the jaw between open and closed positions. A thrust element is pivotally interconnected between a third pivot on the handle and a pivot point at the outer end of the tool body. The handle is pivoted relative to the jaw on an operating stroke moving the jaw from an open position toward a closed position with a rapidly increasing mechanical advantage for providing a maximum compressive force generally aligned with the longitudinal axis of the tool and transversely across the inserted connector as the third pivot approaches the longitudinal axis of the tool body.

14 Claims, 5 Drawing Sheets

HAND TOOL FOR PRESSING WIRE CONNECTORS

BACKGROUND OF THE INVENTION

1. Field of the Invention

The present invention relates to a new and improved hand tool for pressing telephone wire connectors into a conductive condition with a pair or more of insulated telephone wires previously inserted into an open end of the connector before the pressing action is commenced. More particularly, the hand tool of the present invention relates to specific types of wire connectors commonly used in large numbers in the communication industry and known as B-WIRE connectors. These connectors are specially designed to receive two or more strands of insulated copper wire inserted therein, and the hand tool, in accordance with the present invention, is especially designed to compress the connector to a specific geometry so that the insulated conductive wires are properly connected to form a low resistance, reliable, electric connection without requiring the removal of insulation from the wires and a connection that is capable of withstanding relatively high mechanical stresses without failure.

2. Background of the Prior Art

B-WIRE electrical connectors of the type shown in U.S. Pat. Nos. 3,781,985 and 3,839,595 have been used in large numbers for successfully making electrical connections between insulated communication wires inserted into an open end of the connector before mechanical crimping or pressing of the connector to establish a low resistance electrical connection and a high strength mechanical connection between the wires and the connector.

In order to insure that a good low resistance electrical interconnection and a strong mechanical connection is accomplished every time a connector is crimped or pressed, a unique hand tool or press is needed for compressing or pressing the connectors into a specific geometry, which geometry is prescribed by the design of the connector system. The hand tool provides a fixed and movable jaw with flat jaw surfaces for engaging a connector placed therein and one of the jaws is movable from an open position wherein there is approximately 10° between the jaw faces to an accurately calibrated, closed position wherein the angle is reduced to approximately 3.5° and a minimum distance between the jaws is approximately 0.074 inches. This precise geometry is achieved after compression of a connector with the tool and is essential to the connector system. The hand tool or press must be capable of repetitively crimping a large number of connectors with reliable assurance that the jaws will always move to the precisely calibrated, fully closed position as described whenever a connector is compressed. This arrangement will insure that a high quality, low resistance electrical connection is always established at the same time that a high strength mechanical interconnection is made between the connector and the wires inserted therein.

Over the years, a variety of overcenter type, toggle locking wrenches, pliers, clamps, and the like such as shown in U.S. Pat. Nos. 2,853,910; 2,590,034; 3,192,804 and 4,546,680 have been developed to block and hold many different types of articles.

AT&T has developed a relatively expensive and complex hand tool for pressing B-WIRE connectors and the AT&T tool has an automatic locking system which will not release a compressed B-WIRE connector unless a full compression stroke or crimping operation has been completed. In the event that a user in the field does not complete a full compression stroke when crimping a B-WIRE connector, the connector is positively retained by the jaws of the tool until a full compression stroke is finally completed. In addition, the AT&T tool requires the use of shims for accurately calibrating the final position of the jaws of the tool at the end of a connector crimping stroke.

OBJECTS OF THE INVENTION

It is an object of the present invention to provide a new and improved hand tool or press for crimping or compressing B-WIRE type connectors to make an electrical connection between insulated communication wires inserted into the connector from an open end.

More particularly, it is an object of the present invention to provide a new and improved hand tool which is relatively low in cost, easy to use, simple in construction and a tool which stays within the design calibration geometry over a very large number of repetitive operations without requiring service or maintenance.

It is another object of the present invention to provide a new and improved hand tool or presser in accordance with the present invention which, automatically insures that the proper geometry of compression of a connector inserted therein is carried out with precision each time the tool is used.

Another object of the present invention is to provide a new and improved hand tool of the character described which cannot readily be recalibrated by a user in the field so that attempts at field calibration are discouraged.

Still another object of the present invention is to provide a new and improved hand tool of the character described which insures that a movable jaw travels through a full stroke from an angular open position to a calibrated closed position each time a handle stroke is initiated.

More particularly it is an object of the invention to provide a hand tool of the character described which has an operating characteristic making it almost impossible to stop or discontinue a crimping operation once a compression stroke is commenced so that a full compression stroke is automatically insured every time.

Still another object of the present invention is to provide a new and improved hand tool or press of the character described which can be easily recalibrated when returned to a factory representative for service.

BRIEF SUMMARY OF THE PRESENT INVENTION

The foregoing and other objects and advantages of the present invention are accomplished in a new and improved hand tool for pressing or crimping a telephone wire connector to establish an electrical connection between a plurality of insulated wires extended into an open end of the connector. The tool is especially designed for B-WIRE connectors which include a deformable, metal, hollow body having opposed surfaces with a plurality of integrally formed, inwardly directed tines or gripping elements for penetrating the insulating jacket of the wires inserted therein and progressively engaging the central conductor of the wires with less penetration toward the open end of the connector body.

The hand tool includes an elongated body having a recess for receiving a connector and the recess includes a fixed end wall of the body on one side and has an open mouth into which a connector and the wires to be connected are inserted, generally at right angles to the length of the tool body. A movable jaw is pivotally mounted on the tool body for movement about a first pivot axis spaced apart from the recess so that the jaw moves toward and away from the fixed wall of the recess between an open position ready to receive a B-WIRE connector and wires inserted therein and a precisely calibrated, closed jaw position wherein the movable jaw and the fixed jaw surfaces are positioned in a predetermined, precisely calibrated geometric configuration for carefully compressing the body of a B-WIRE connector to make a low resistance, electrical connection between the connector and the several wires inserted therein.

An elongated operating handle having a forward end portion pivotally secured to the movable jaw about a second pivot axis extends outwardly therefrom and the handle has an opposite outer end portion which is manually squeezed by a user to move toward the body and pivot the movable jaw on a compression or crimping stroke between the jaw open and jaw closed position. An elongated link or thrust member is pivotally interconnected at a forward end to the operating handle at a third pivot axis or point intermediate the ends of the handle. A rear end of the thrust member is supported adjacent a rear body portion for limited pivotal movement about a fourth pivot axis which is adjusted to provide precise calibration of the tool.

A jaw closed operating stop is provided for limiting angular movement of the operating handle in a crimping stroke toward the jaw closed position and this stop is effective to prevent the third pivot axis at the joint between the thrust link and the handle from crossing over the center of a line extended between the second and fourth pivot axes previously described. Another stop is provided for limiting the outward angular movement of the operating handle away from the tool body toward the jaw open position wherein each successive new pressure stroke or crimping operation is commenced each time the tool is used to press or crimp a connector placed in the open recess of the tool.

The thrust member has a length measured between the third and fourth pivot axes that is substantially greater than a distance between the first and second pivot axes on the jaw and force applied on the handle for movement on a connector crimping stroke from the jaw open position toward the jaw closed position results in a rapidly increasing pressure or force on a connector in position between the jaws of the tool at the end of the stroke at the time that the jaw closed stop is engaged. Because of the rapidly increasing mechanical advantage as the movable jaw pivots toward the jaw closed position, the jaw pressure acting on a B-WIRE connector approaches a maximum as the handle is driven fully home against the jaw closed stop. Each time a new stroke is commenced from a jaw open position, it is literally impossible to stop the handle movement short of a fully closed position because of the rapidly increasing mechanical advantage. Moreover, because the third pivot axis does not move over center across a line extending between the second and fourth pivot axes of the tool, the handle can be readily moved back to the jaw open position and often will snap back open in readiness for the next crimping operation without the need for a mechanical release or the actuation of a release latch.

BRIEF DESCRIPTION OF THE DRAWINGS

For a better understanding of the present invention, reference should be had to the following detailed description taken in conjunction with the drawings in which.

DETAILED DESCRIPTION OF A PREFERRED EMBODIMENT OF THE PRESENT INVENTION

Figures 1, 2, 3, 4, 5:
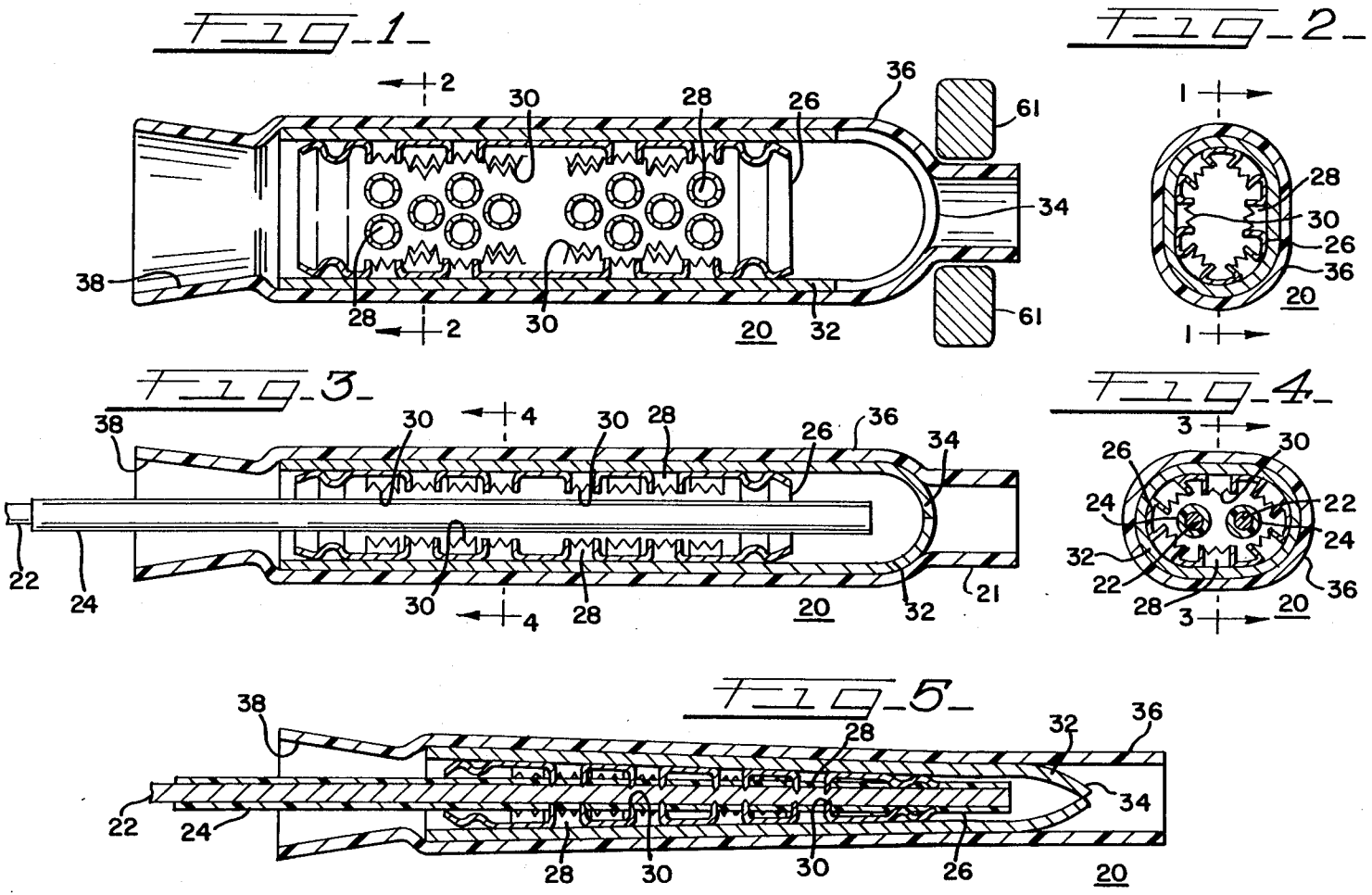
FIG. 1 is a longitudinal cross-sectional view of a B-WIRE connector of the type that is compressed to make an electrical connection by a hand tool constructed in accordance with the present invention.
FIG. 2 is a cross-sectional view taken substantially along lines 2—2 of FIG. 1.
FIG. 3 is an elongated cross-sectional view of a B-WIRE connector shown with a pair of wires inserted therein ready for connection.
FIG. 4 is a cross-sectional view taken substantially along lines 4—4 of FIG. 3.
FIG. 5 is a longitudinal cross-sectional view similar to FIG. 3 but illustrating the B wire connection after compression or crimping has taken place to make an electrical connection using a hand tool in accordance with the present invention.

Referring now more particularly to the drawings, FIGS. 1 through 5 illustrate a typical B-WIRE type electrical connector referred to generally by the reference numeral 20 and widely used in the telephone and communications industry for making an electrical connection between a plurality of electrical wires 22 having an outer insulating jackets 24 thereon which are inserted into the hollow end of the connector. The B-WIRE connector 20 includes an inner, connection element 26 formed of tin coated, spring temper, phosphor bronze sheet material and containing some sixty perforations 28 spaced over the hollow, tubular body and adapted to form piercing tines or gripping elements 30 for penetrating the insulating jacket 24 and making electrical contact with the central conductors 22 when the hollow body of the inner element 26 is compressed to the specific geometrical shape as illustrated in FIG. 5.

The deformable, hollow, tubular inner gripping element 26 is inserted into an annealed brass shell 32, also of tubular shape and closed at an inner end 34 to limit the travel of the conductors 22 when inserted into the connector 20. The connector 20 also includes a hollow, tubular, outer insulating cover 36 formed of tough, flexible plastic material and having high mechanical and dielectric strength to withstand compression forces when the connector 20 is compressed to the tapered shape as shown in FIG. 5 by a hand tool in accordance with the present invention. The insulating cover 36 includes a flared open end 38 for guiding the insertion of the wires 22 in preparation for making a connection.

In order to insure a good mechanical connection and at the same time a good, low-resistance electrical interconnection between the wires 22 inserted into the connector 20, it is necessary that the deformable metal elements 26 and 32 be pressed, crimped or compressed into a geometrically tapered shape as illustrated in FIG. 5, wherein the gripping elements or tines 30 penetrate the wires 22 by progressively increasing amounts toward the open end of the connector. The tines 30 penetrate through the insulating jacket 24 on the wires 22 to make positive, low resistance electrical contact between the plurality of wires 22 and the inner connector element 26.

A special tool is required to press the B-WIRE connector 20 into conducting condition with the wires 22 that have been fully inserted into the central opening. The jaws of the presser tool are precisely set at an angle of 3.5° with a minimum approach of 0.074" when fully closed, and this produces a tapered penetration of the tines into the inserted wires which assures low connection resistance by deep penetration of many tines in the inner portion of the connector, while providing mechanical support and preserving the tensile integrity of the wires by less penetration at the entrance end of the connector.

The hand pressing tools are designed to force this calibrated press geometry (3.5° –0.074" Min.) whenever the presser tool is used and to maintain this precise calibration over a very long period of normal use without any adjustment. The calibration of the presser tool can be checked occasionally by pressing a special test solder wire furnished with the presser tool for this purpose, and a calibration slot 0.074" in width is provided on the tool for making this check.

Referring now more particularly to FIGS. 6 through 12, therein is illustrated a new and improved hand tool or hand press referred to generally by the reference numeral 40 and especially designed and adapted for crimping or compressing B-WIRE connectors 20 in order to make a high quality, low resistance electrical and at the same time a high strength mechanical connection between the wires 22 inserted into the connector. The hand tool 40 includes an elongated base 42 preferably formed of aluminum and having a flat bottom wall 44 and a pair of opposite sidewalls 46 defining a U-shaped transverse crosssection to form an elongated, centrally disposed recess 48 extending between a solid rear end portion or end block 50 and a forward end block 52 which defines a fixed wall of a recess 54 for receiving a wire connector 20 to be crimped into the tapered configuration of FIG. 5.

Figure 6:
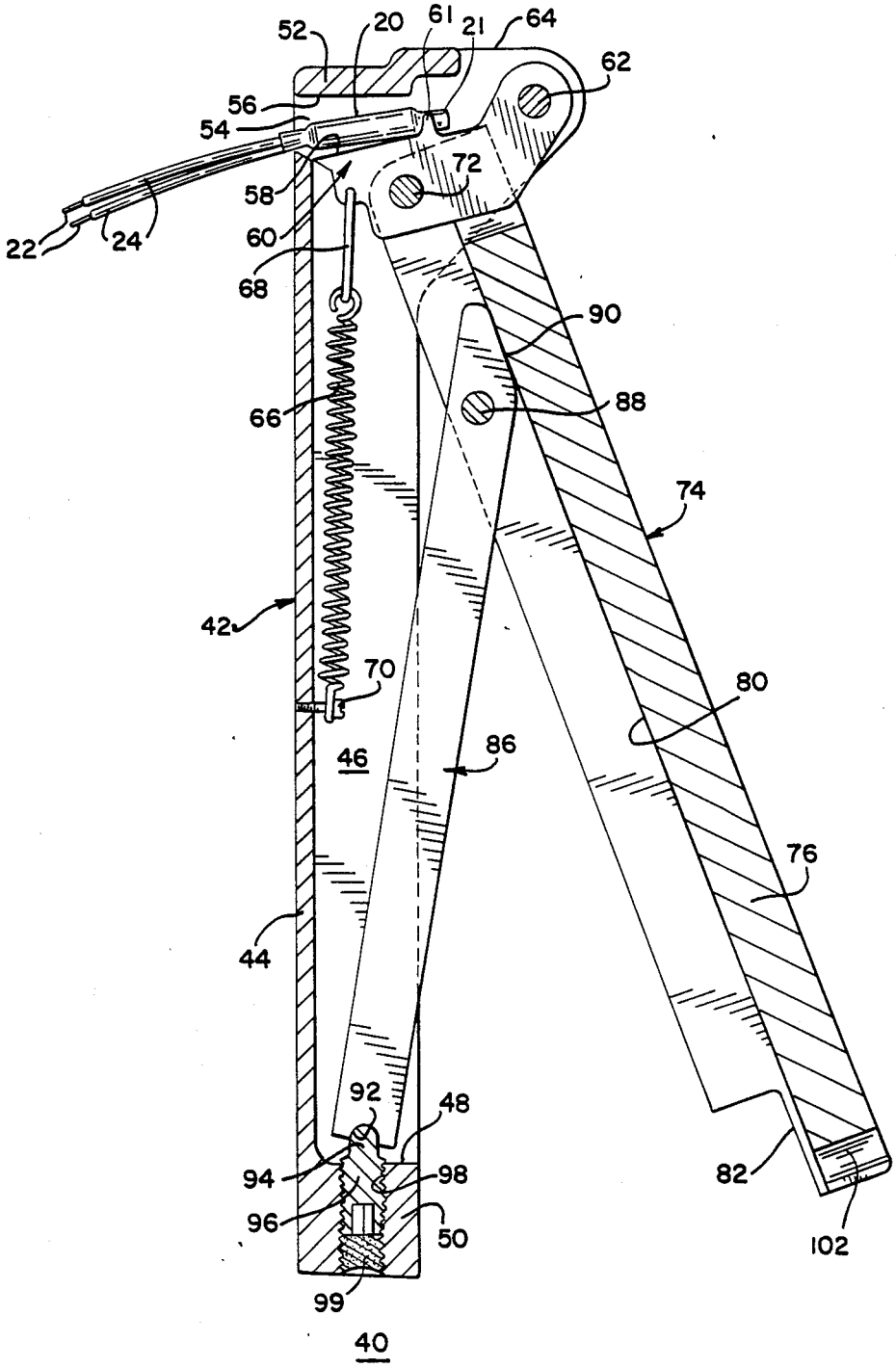
FIG. 6 is a longitudinal cross-sectional view of a new and improved hand tool constructed in accordance with the features of the present invention and illustrated with a movable jaw in an open position forming an open mouth or recess for receiving a connector and inserted wires, to be connected.
Figure 12:
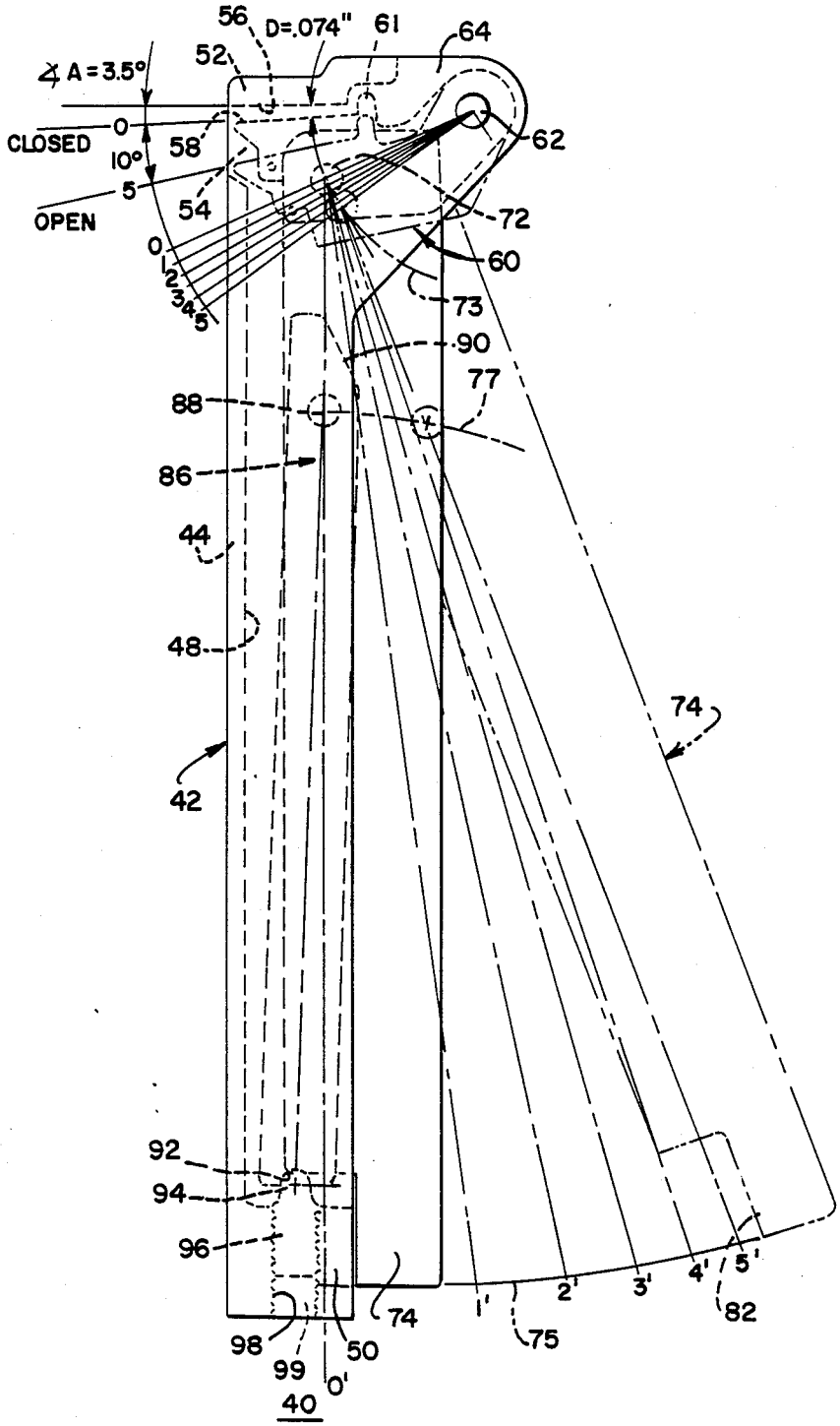
FIG. 12 is side elevational view of the tool with sequential operating positions of the movable jaw and handle shown,. in phantom or dotted lines.

The forward end block 52 includes a planar or flat inside surface comprising a fixed jaw surface 56 for opposing a movable jaw surface 58 formed on a movable jaw 60 pivotally mounted at the forward end of the body 42 on a relatively large diameter pivot pin 62. The pivot pin 62 is supported to extend between a pair of upstanding ears 64 integral with the opposite, body sidewalls 46 of the tool body 42. The swinging jaw 60 is pivotally movable from a fully open position as shown in FIG. 6 wherein the jaw surfaces 56 and 58 diverge at a maximum angle of approximately 10° to a precision calibrated, jaw closed position as shown in FIG. 12 wherein the opposing jaw surfaces 56 and 58 diverge at an angle of approximately 3.5° and have a minimum approach distance of 0.074" for precise crimping action on the connectors 20 to provide a strong, low resistance electrical connection referred to previously. As illustrated in FIG. 12, when the movable jaw 60 is in a fully closed position, a precise minimum approach or spacing distance "D" of approximately 0.074" is present between the jaw surfaces 56 and 58.

Figure 8:
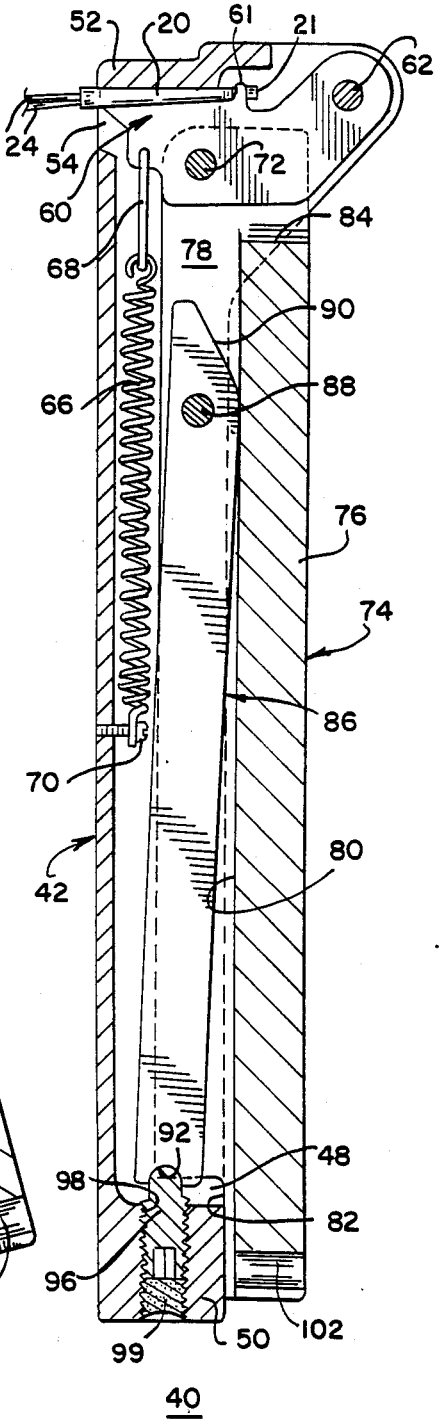
FIG. 8 is a longitudinal cross-sectional view of the hand tool illustrating the movable jaw in a fully closed position after a compression or pressing stroke has been fully completed to crimp or compress a B-WIRE connector to make an electrical connection between the wires inserted therein.

Referring to FIG. 6, the pivotal jaw 60 is biased in a counterclockwise direction about the support pin 62 by means of an elongated coil spring 66 having a forward end connected to the jaw through a wire hook element 68. A rearward end of the spring 66 is connected to the bottom wall 42 of the tool body 40 by means cap screw 70. As illustrated in FIG. 8, when the jaw 60 is fully closed, the spring 66 exerts a substantial opening effort on the jaw, and no unlatching is required.

Figure 7:
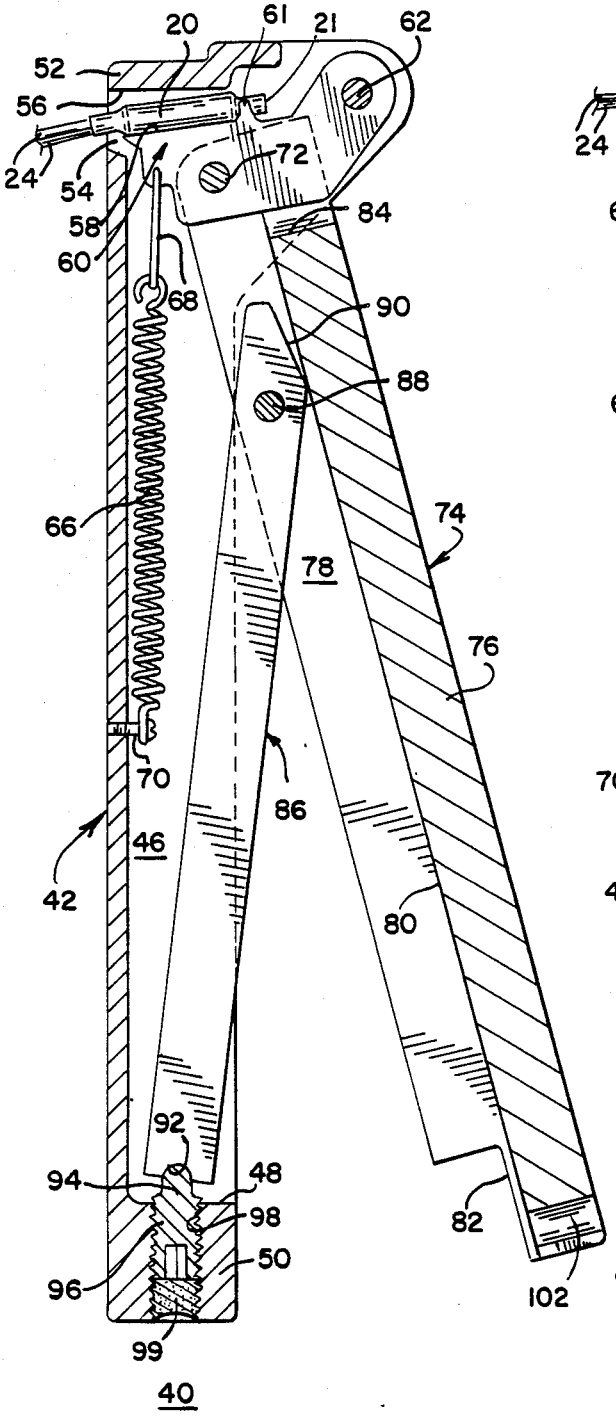
FIG. 7 is a longitudinal cross-sectional view similar to FIG. 6 but illustrating the components of the hand tool after a compression or crimping stroke has been initiated and partially completed.
Figure 9:
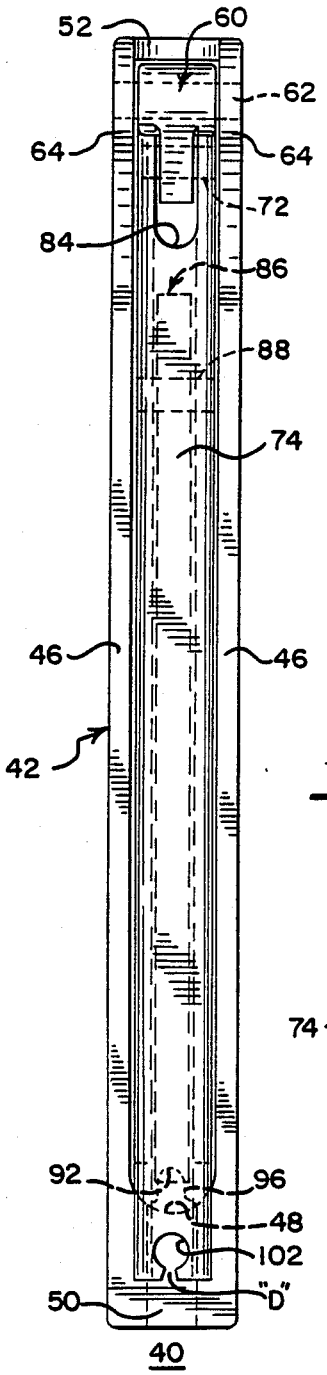
FIG. 9 is a top plan view of the hand tool.
Figure 10:
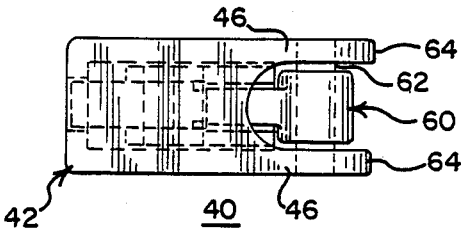
FIG. 10 is a front end view of the hand tool.
Figure 11:
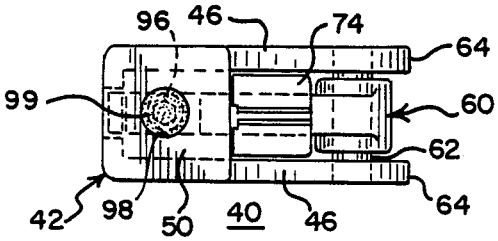
FIG. 11 is a rear end view of the hand tool.

In accordance with the present invention, a pivot pin 72 of relatively large diameter is extended through the body of the movable jaw 60 intermediately between the jaw surface 58 and the pivot pin 62. The intermediate pin 72 connects and supports a forward end portion of an elongated handle 74 having an inverted, U-shaped transverse cross-section and preferably formed of aluminum. The elongated handle includes a solid back 76 integrally joined to a pair of depending sidewalls 78 to provide the channel-shaped or U-shaped transverse cross-section which defines an elongated, recess 80 on the underside of the handle. Both of the handle sidewalls 78 are formed with a notched-out segment 82 at the outer or rear end providing a stop surface for engaging the rear end block 50 of the tool body 42 when the handle is in a fully closed position as shown in FIGS. 8, 9 and 12. This stopping engagement between the handle surfaces 82 and the top surface of the rear end block 50 acts as a positive stop to limit further closing movement of the movable jaw surface 58 towards the fixed jaw surface 56 and thereby establish the precise angular and spatial relationship between the jaw surfaces 56 and 58 when the movable jaw 60 reaches the jaw closed position. At the forward end of the handle 74, a portion of the handle back 76 is milled out and removed as at 84 in order to permit free relative pivotal movement between the movable jaw 60 and the handle 74 around the pivot pin 72 as shown in FIGS. 6, 7 and 8.

In accordance with the present invention, the hand tool or presser 40 includes an elongated thrust member or toggle link 86 pivotally interconnected to the handle 74 by a relatively large diameter pivot pin 88 spaced intermediately between the pivot pin 72 at the forward end of the handle and the rearward or outer end portion of the handle. The forward end of the toggle link 86 is formed with a beveled stop surface 90 which is engageable with the inside face of the handle back 76 within the recess 80 to limit the full open position of the handle 74 to the angularly divergent position shown wherein the open jaw surfaces 56 and 58 are diverging at an angle of approximately 10° as illustrated in FIG. 12.

When the rearward or outer end portion of the handle 74 is manually squeezed inwardly toward the body 42 to commence an operating stroke to crimp or compress a connector 20, the forward stop surface 90 moves away from engagement with the inside surface of the handle back 76 and eventually when the handle 74 reaches a near parallel position (O-line position - FIG. 12) with the main body 42, the stop surfaces 82 engage the rear end block 50 of the tool body 42 to provide a positive stop for limiting the jaw movement to provide a minimum 3.5° diverging angle between the jaw surfaces 56 and 58 and a minimum spacing of 0.074" as previously referred to.

At the rearward end, the toggle link or thrust member 86 is provided with a spherical recess 92 in order to support the rear end of the toggle link for pivotal movement on a hemispherically shaped nose 94 of a tool calibrating set screw 96. The set screw 96 has a socket in the outer end as shown in FIGS. 6, 7 and 8, for receiving an "Allen" wrench used for adjustment. The set screw is mounted in a threaded bore 98 provided in the rear end block 50 of the handle body 42.

When the movable jaw 60 is in a fully closed or connector crimping position (FIGS. 8 and 12), the jaw surfaces 56 and 58 are calibrated to angularly diverge at 3.5° with a minimum approach spacing of 0.074" by adjustment of the set screw 96 in the bore 98. After this adjustment is made, the threaded cavity in the bore 98 is filled with a hot melt type adhesive forming a plug 99 for preventing access to the set screw 96, and the set screw cannot be moved after the initial calibration at the factory when the adhesive is solidified. Subsequently, if the tool 40 gets out of calibration because of wear, etc., recalibration is accomplished using an appropriately heated "Allen" wrench. A heated "Allen" wrench is inserted into the socket of the set screw 96 through the hot melt adhesive plug 99 after the plug becomes liquified enough to permit the set screw to be turned in the bore 98 as necessary. It has been found, however, that even after approximately a quarter of a million operations with the tool 40, no re-calibration has been required.

Referring now to FIG. 12, the movable jaw 60 pivots about the primary pivot pin 62 through an angle of approximately 6.5° when moving on an operation stroke from the 10°, fully open position to the precision calibrated, fully closed position wherein a 3.5° angle is established between the jaw faces 56 and 58 and a minimum spacing of 0.074" is present. Radius lines numbered 0, 1, 2, 3, 4 and 5 emanating from the pivot pin 62 on FIG. 12 disclose angular movement of the movable jaw 60 between the jaw closed or 0 position and the jaw open or 5 position. Radius lines 0, 1, 2, 3, 4 and 5, emanating from the fixed pivot pin 62 and passing through the movable pivot pin 72 represent equal increments of movement of the jaw surface 58 between the closed position and the open position along a circumferential arc 73 extending through a middle portion of the movable jaw surface 58. These incremental circumferential distances along the arc 73 are of equal length between respective pairs of adjacent radial lines 0, 1, 2, 3, 4 and 5.

Referring now to the handle 74 as shown in FIG. 12, a line 75 represents the locus of an outer end surface of the handle when the handle is moved from the jaw open position (corresponding to line 5') to the fully closed position, (corresponding to line 0'. Incremental distances on locus line 75 between adjacent handle position lines 0', 1', 2', 3', 4' and 5' correspond to much smaller incremental distances on circumferential arc 73 between adjacent jaw position radius lines 1, 1, 2, 3, 4 and 5, respectively. However, the successive incremental distances on locus line 75 are not of equal length like the corresponding successive incremental distances on the circumferential arc line 73. Moreover, the incremental distances on locus line 75 are much larger than their counterparts on arc line 73 and the ratio between corresponding incremental distances on the lines 75 and 73 represents the mechanical advantage of the tool. For example, the incremental distance between position lines 4' and 5' on locus line 75 is four or five times greater than the corresponding incremental distance between radials 4 and 5 on circumferential arc line 73 providing a mechanical advantage of 4 or 5 at the time a compression stroke is initiated. This ratio or mechanical advantage increases rapidly as the handle 74 is moved to close the jaw 60. At the end of a compression stroke, for example, the incremental distance along locus line 75 between position lines 1' and 0' is 28 to 30 times greater than the corresponding, incremental distance between radials 1 and 0 along circumferential arc line 73, thus resulting in a mechanical advantage of 28 to 30.

Arcuate line 77 in FIG. 12 represents the locus of travel of the pivot pin 88. The line 77 is a circumferential arc around the set screw pivot surface 94 as a center. The relative position of the pivot pin 72 on the arc line 73 and the pivot pin 88 on the arc line 77 determine the angular diversion of the handle 74 from the body 42 as the handle is moved between open and closed positions. The pivot pins 72 and 88 are always a constant distance apart as determined by the spacing holes for the pins on the handle 74.

The linkage arrangement of the tool 40 is designed so that once a crimping or compression stroke is commenced by hand pressure on the handle 74 in the fully open position, it is literally impossible to stop the closing movement of the handle before completion of a full compression stroke wherein the jaw 60 reaches the fully closed position with the desired 3.5° angular spread between the jaw surfaces 56 and 58. Because of the rapidly increasing mechanical advantage as the handle is squeezed to close the jaw 60 rapid movement of the jaw to the fully closed geometric configuration is virtually assured each time the tool is used to compress a connector 20. Moreover, the pivot pin 88 never passes over the center of a line extending between the movable pivot pin 72 and the fixed pivot axis of the spherical ball 94 of the set screw 96, (as will be seen in FIG. 12), however, the thrust member 86 does closely approach this overcenter line when the jaw 60 finally reaches a jaw closed position. The need for releasing a latch in order to move linkage members back over center that is common in other toggle link mechanisms is not required with the tool 40.

After the jaw 60 is moved to a fully closed, connector crimping position and the connector 20 is fully compressed, the handle 74 normally tends to remain momentarily in this fully closed position (FIG. 8) because of the natural resiliency of the components of the tool and the connector 20. However, the handle 74 can easily be released by a simple hand pull in an outward direction on the outer end portion. When a slight pull is initiated, the handle normally snaps rapidly outward to the full open position and the opening jaw surfaces 56 and 58 release the crimped connector 20 and wires 22 from the tool recess 54. A distance measured on the movable jaw 60 between the fixed pivot pin 62 and the movable pivot pin 72 is designed to be substantially less than a distance measured on the thrust member 86 between the movable pivot pin 88 and the fixed pivot on the set screw ball surface 94, or the distance between outer end surface of the handle 74 and the movable pivot pin 72 at the inner end of the handle. This geometry provides a high and rapidly increasing mechanical advantage for crimping a connector 20 as the movable jaw 60 is closed.

Figure 13:
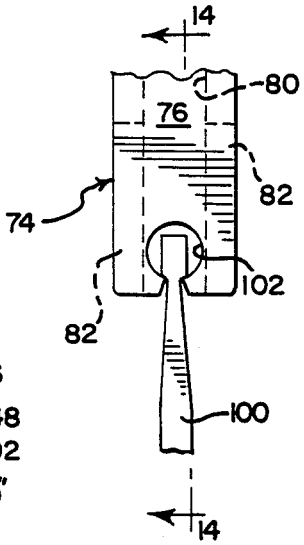
FIG. 13 is an enlarged fragmentary, top view of a rearward end portion of the hand tool illustrating how a piece of solder compressed in the jaw may be utilized for field checking the calibration of the tool.
Figure 14:
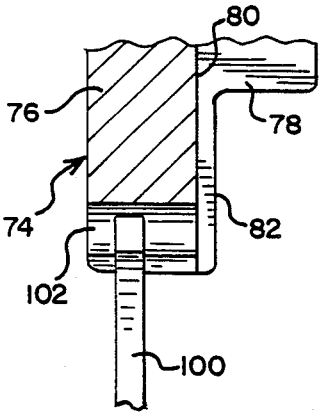
FIG. 14 is a fragmentary cross-sectional view taken substantially along lines 14—14 of FIG. 13.

For the purpose of checking the calibration of the tool 40 in the field during use, each tool is supplied with a test strip 100 formed of solder. The solder strip is soft and does not "spring back" after compression between the jaw surfaces 56 and 58. If a user thinks the tool 40 is out of calibration, the solder test strip 100 is inserted into the recess 54 and crimped between the jaw surfaces 56 and 58. After crimping, the solder strip 100 has a narrow neck as illustrated in FIG. 13, which shape precisely reflects the geometry of the jaw surfaces 56 and 58 in the jaw closed position. At the rearward end portion, the tool handle 74 is provided with a keyhole-shaped test 10 slot 102 having a calibration distance of 0.074" between spaced apart points at the narrowest width. If a compressed strip of test solder 100 can be readily moved into the keyhole slot 102 and past these points with very little pressure being required, the tool 40 is in correct calibration and the set screw 96 need not be adjusted in the threaded bore 98. If the test strip 100 will not pass between the points of the slot 102, the tool is out of calibration and should be returned to the factory or service center for recalibration.

Initial movement of the handle 74 on an operating, or jaw closing stroke by manual force applied to the handle 74 causes the jaw 60 to move to the fully closed position and the pressure exerted on a connector 20 between the jaw surfaces 56 and 58 increases substantially to a maximum amount which is present at the time that the connector 20 is fully compressed to the desired geometry. This arrangement essentially eliminates the possibility of a user of the tool 40 not completing a full crimping or compression stroke each time a connector 20 is compressed and thus failure of electrical connections is virtually eliminated when connectors 20 are crimped with the tool 40. In addition, the novel linkage arrangement of the tool 40 and the elimination of a need to go beyond overcenter with the pivot pin 88 eliminates any requirement for releasing a latch or the like. Latches are thought to be a necessity on most "VICE-GRIP" type holding pliers and the like.

The movable jaw 60 is provided with a pair of spaced apart lugs 61 projecting outwardly of the jaw surface 58 at the inner end thereof and these lugs provide stops for engaging a connector 20 inserted into the tool recess 54 to limit the inward travel and center the connector between the jaw surfaces 56 and 58. When a connector 20 is properly positioned between the jaw surfaces 56 and 58 ready for crimping, a narrow neck portion 21 at the closed end of the connector body is sandwiched between the lugs 61 as shown in FIG. 1, thereby centering the connector 20 between the jaw surfaces of the tool 40.

Many modifications and variations of the present invention are possible in light of the foregoing specification and thus, it is to be understood that within the scope of the appended claims, the invention may be practiced otherwise than as specifically described.

What is claimed and desired to be secured by Letters Patent of the United States is:

1. An improved hand tool for repeatedly compressing successive telephone wire connectors to a precise geometric configuration in order to establish a high quality electrical connection between a plurality of insulated wires extended into an open end of said connectors, said connectors being of a type including a deformable hollow metal body having opposed surfaces with a plurality of integral, inwardly directed gripping elements for penetrating insulating jackets of said wires and engaging central conductors thereof with progressively less penetration toward said open end; said improved hand tool comprising:

an elongated body having a mouth open on one side of said body for receiving one of said connectors inserted into said mouth and engaged on one side by a fixed jaw surface formed adjacent an end of said body extending transversely across a longitudinal axis thereof, said one side of said body comprising a fixed handle portion of said tool extending between said fixed jaw surface and a remote pivot point along said longitudinal axis adjacent an opposite end of said body;

a movable jaw pivotally mounted on said body for rotation about a first pivot laterally offset from said longitudinal axis and in line with the fixed jaw surface and having a movable jaw surface opposite said fixed jaw surface of said mouth, and movable jaw surface extending transversely across said longitudinal axis between said fixed jaw surface and said remote pivot point for movement toward and away from said fixed jaw surface of said mouth for compressing said metal body of said connector inserted into said mouth from said open side into a precise tapered configuration of predetermined dimensions thereby establishing a strong electrical and mechanical connection between said central conductors of said wires inserted into said connector;

an operating handle having one end portion pivotally secured to said movable jaw about a second pivot spaced from said first pivot toward said longitudinal axis and having an opposite end portion manually movable toward and away from said opposite end of said body for pivoting said movable jaw between precise open and closed positions relative to said fixed jaw surface of said mouth;

an elongate thrust member pivotally interconnected between said operating handle and said remote pivot on said fixed handle portion of said body, said thrust member having one end pivotally connected to said operating handle about a third pivot thereon spaced between said second pivot and said opposite end portion of said operating handle, said thrust member including an opposite end pivotally mounted on said remote pivot on said body; and said operating handle being relatively pivoted with respect to said movable jaw upon movement of said handle from a jaw open position toward a jaw closed position providing a rapidly increasing ratio of handle movement to jaw closing movement of said movable jaw for compressing said connector with a maximum force generally aligned with said longitudinal axis of said tool as said third pivot approaches said longitudinal axis.

2. The handle tool of claim 1, including:

first stop means for limiting angular movement of said operating handle toward said jaw closing position so that said third pivot does not cross an over-center line extending between said second pivot and said remote pivot.

3. The hand tool of claim 2, including second stop means for limiting angular movement of said operating handle away from said body in said jaw closed position.

4. The hand tool of claim 1, wherein:

said body has a U-shaped transverse cross-section intermediate its ends forming an elongated cavity for receiving an elongated portion of said operating handle in nested relation when said operating handle approaches said jaw closed position.

5. The hand tool of claim 4, wherein:

said operating handle has U-shaped transverse cross-section forming an elongated cavity facing said elongated cavity in said tool body for receiving an elongate portion of said thrust member in nested relation when said elongated portion of said operating handle approaches said nested relation with said body in said jaw closed position.

6. The hand tool of claim 5, including:

first stop means for limiting angular movement of said operating handle toward said jaw closing position so that said third pivot does not cross an over center line extending between said second pivot and said remote pivot.

7. The hand tool of claim 6, including:

second stop means for limiting angular movement of said operating handle away from said body in said jaw closed position.

8. The hand tool of claim 6, wherein:

said first stop means includes interacting stop surfaces on said operating handle and said body adjacent said opposite and portion engageable for limiting said relative angular movement of said operating handle toward said body when said movable jaw approaches said jaw closed position.

9. The hand tool of claim 7, wherein:

said second stop means includes interacting stop surfaces adjacent said one end of said thrust member and said operating handle engageable for limiting said relative angular movement of said operating handle away from said body when said jaw approaches said jaw open position.

10. The hand tool of claim 1, including:

calibration means mounted on said body and adjustable thereon for movement of said remote pivot along said longitudinal axis to obtain a precise spacing between said movable jaw surface and said fixed jaw surface of said mouth when said movable jaw is in said jaw closed position.

11. The hand tool of claim 10, wherein:

said calibration means includes set screw means threadedly engaged in said body and including a pivot surface engaging an opposite end of said thrust member permitting relative pivotal movement therebetween.

12. The hand tool of claim 11, wherein:

said calibration means includes heat sensitive adhesive means for engaging said set screw means and said body to secure said set screw in a selected threaded position in said body.

13. The hand tool of claim 12, wherein:

said body includes an elongated threaded bore for receiving said set screw means and having an open outer end for receiving a heated calibration tool for adjusting said set screw means in said bore after said adhesive is heated sufficiently to allow turning of said set screw means in said bore.

14. The hand tool of claim 13, wherein:

said set screw means includes a ball at an inner end for pivotally supporting a socket in said opposite end of said thrust member to permit relative pivotal movement of said thrust member and body about said remote pivot as said movable jaw is opened and closed.

* * * * *